United States Patent [19]

Hodges

[11] Patent Number: 4,756,136

[45] Date of Patent: Jul. 12, 1988

[54] INTERLOCKING SPACER APPARATUS FOR MASONRY CONSTRUCTION

[76] Inventor: Philip R. Hodges, P.O. Box 1617, Petersburg, Va. 23805

[21] Appl. No.: 29,884

[22] Filed: Mar. 25, 1987

Related U.S. Application Data

[63] Continuation of Ser. No. 835,773, Mar. 3, 1986, Pat. No. 4,689,931.

[51] Int. Cl.[4] ..... E04C 5/16

[52] U.S. Cl. ..... 52/687; 52/712

[58] Field of Search ..... 52/562, 442, 563, 687, 52/713, 421, 712, 664, 671, 672

[56] References Cited

U.S. PATENT DOCUMENTS

| | | | |
|---|---|---|---|
| 577,002 | 2/1897 | Blodgett | 52/712 |
| 733,187 | 7/1903 | Grant | 52/712 |
| 767,582 | 8/1904 | Lewman | 52/713 |
| 814,134 | 3/1906 | Hood | 52/714 |
| 941,617 | 11/1909 | Chapman | 52/712 |
| 978,948 | 12/1910 | Shean | 52/714 |
| 1,076,836 | 10/1913 | Merwin | 52/714 |
| 1,116,928 | 11/1914 | Sanderson | 52/712 |
| 1,117,908 | 11/1914 | Ridgeway | 52/712 |
| 1,304,815 | 5/1919 | Sharp | 52/712 |
| 1,499,171 | 6/1924 | Green . | |
| 1,561,323 | 11/1925 | Gregg | 52/687 |
| 1,943,485 | 1/1934 | Osborne | 52/712 |
| 2,008,672 | 7/1935 | Nieman | 52/442 |
| 2,114,906 | 4/1938 | Nyhagen, Jr. | 52/421 |
| 2,124,799 | 7/1938 | Specht | 52/712 |
| 2,616,180 | 11/1952 | Parker . | |
| 3,293,810 | 12/1966 | Cox | 52/714 |
| 3,300,939 | 1/1967 | Jolfsson | 52/562 |
| 3,336,712 | 8/1967 | Bartley | 52/714 |
| 3,653,170 | 4/1972 | Sheckler | 52/375 |
| 4,005,560 | 2/1977 | Simpson | 52/712 |
| 4,021,990 | 5/1977 | Schwalberg | 52/712 |
| 4,136,498 | 1/1979 | Kanigan | 52/604 |
| 4,334,397 | 6/1982 | Hitz | 52/687 |

*Primary Examiner*—John E. Murtagh

*Attorney, Agent, or Firm*—Kerkam, Stowell, Kondracki & Clarke

[57] ABSTRACT

A masonry construction device useful for uniformly spacing adjacent masonry elements, for reinforcing the elements, and for tying the elements to an adjacent structure, comprises a pair of spaced sawtooth shaped members having a plurality of bearing surfaces for engaging the adjacent masonry elements, and a bridging member connected between the sawtooth shaped members such that the device has a substantially U-shaped configuration.

15 Claims, 3 Drawing Sheets

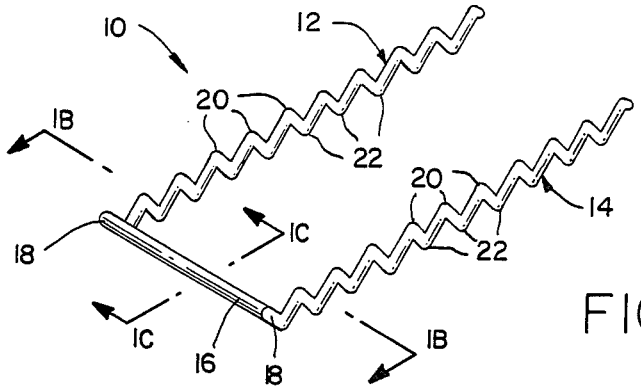
FIG. 1A
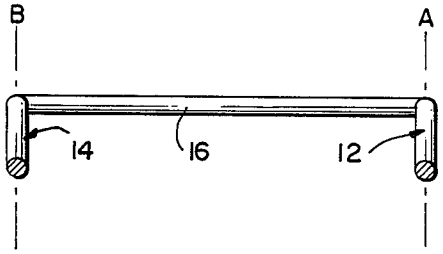
FIG. 1B
FIG. 1C
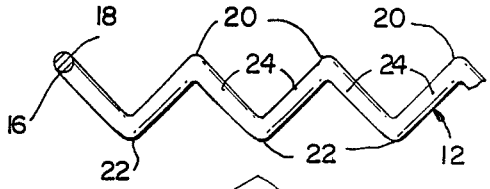
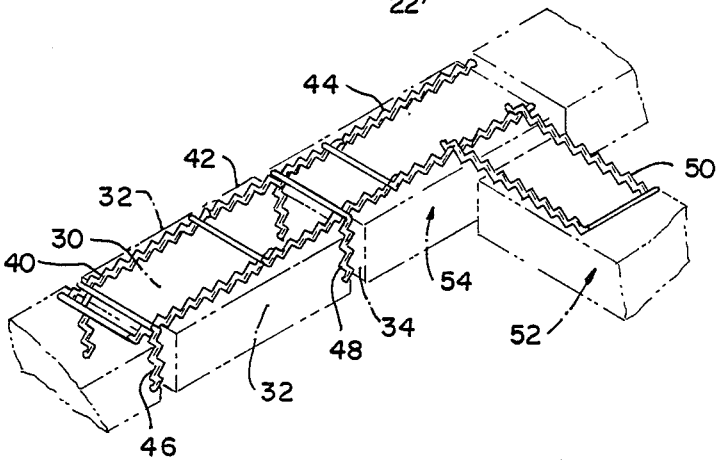
FIG. 2

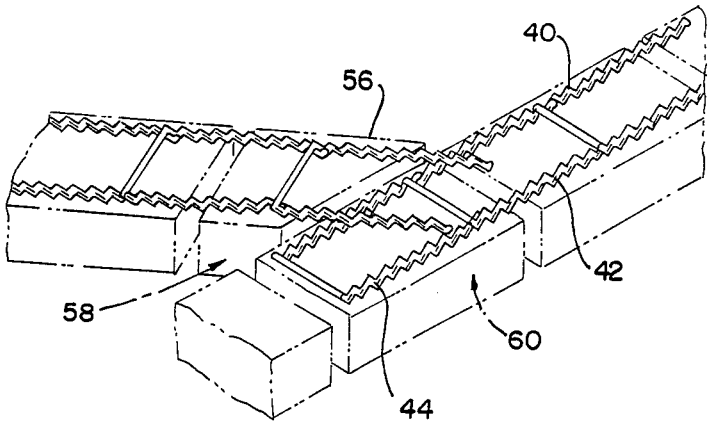
FIG. 6
FIG. 7
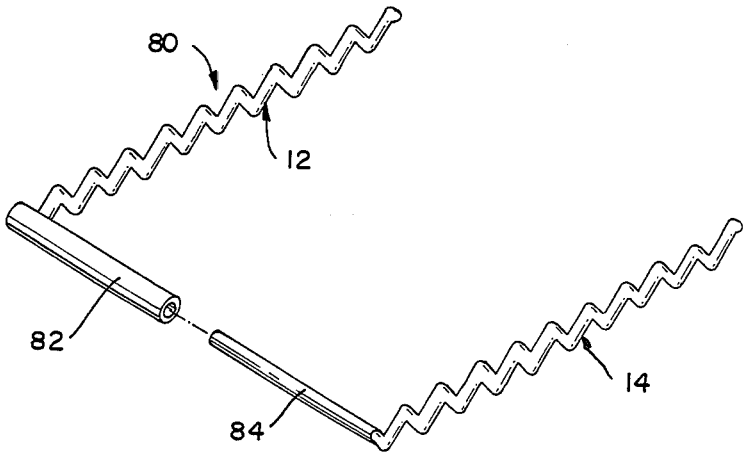

INTERLOCKING SPACER APPARATUS FOR MASONRY CONSTRUCTION

This is a continuation of application Ser. No. 835,773, filed Mar. 3, 1986, now U.S. Pat. No. 4,689,931.

BACKGROUND OF THE INVENTION

This invention relates generally to masonry construction, and more particularly to devices for spacing masonry elements, for reinforcing masonry construction, and for tying the masonry construction to an adjacent structure.

In constructing masonry structures, masonry elements, such as brick, block, or stone, are laid in rows known as courses, and the joints between adjacent elements are filled with mortar, grout, or other bonding or sealing material which secures adjacent elements together. It is desirable that the masonry elements be uniformly spaced, both for the sake of the appearance of the completed construction as well as to insure that the joints contain sufficient mortar or other material to hold the elements securely together. Obtaining uniform joints requires considerable skill and experience on the part of the workman and depends on his ability to judge the amount of material required between elements so that the joints have uniform thickness. This is complicated by the fact that some settling and exuding of mortar from joints may occur due to the weight of the masonry elements in higher courses.

Devices are known which may be placed in the wet mortar of masonry joints for uniformly spacing adjacent masonry elements. However, such known devices suffer from a number of disadvantages. Typically, they are formed to be used with a particular type of masonry element, such as brick or block, and with a standard size element, and the devices are not readily adaptable for use with other types or sizes of masonry elements. Moreover, even when used with the same type of masonry element, different sized devices are often required depending upon whether they are to be used between the sides of the elements, between the ends of the elements, or with different sized elements of the same type, e.g., half brick or half block. The need for different sizes and types of spacer devices is both inconvenient and expensive.

It is also desirable in masonry construction to employ reinforcing to tie the masonry elements together and afford added strength. Typically, this is accomplished by laying long lengths of reinforcing elements, such as rods or wire grids, in the wet mortar between every third or fourth course, for example. Known reinforcing elements also have disadvantages, including the necessity for forming or shaping the elements in accordance witn the length and the shape of the course, and the necessity of wiring or otherwise tying the reinforcing elements together if connection between adjacent reinforcing elements is desired. In some instances, it is also desirable to tie a masonry construction to an adjacent structure, as, for example, tying a brick veneer outer wall to an inner wooden wall. Reinforcing elements or other specially formed devices may be employed for this purpose. However, this requires either specially shaping and sizing the reinforcing element so that it may project from a joint to enable it to be secured to the adjacent structure, which is laborious and time consuming, or requires that a supply of these specially formed tie devices be maintained, which is inconvenient.

It is desirable to provide a masonry construction device which avoids these and other disadvantages of known masonry construction devices, and it is to this end that the present invention is directed.

SUMMARY OF THE INVENTION

The invention affords a highly advantageous and versatile masonry construction device which solves the foregoing problems and has significant advantages over known masonry construction devices. Devices in accordance with the invention have a rather simple and inexpensive construction, and combine in a single device the functions of a spacer for uniformly spacing adjacent masonry elements, a reinforcing element, and a wall tie for tying a masonry construction to an adjacent structure. Devices in accordance with the invention are readily adjustable in length using common hand tools, such as wire cutters, so that the same device may be employed either at the sides, e.g., top and bottom, of a masonry element, at the ends of the masonry element, or with masonry elements which have had their sizes modified, as half or quarter brick or block. Devices in accordance with the invention are substantially continuously interlocking so that two or more devices may be interlocked together in a plurality of different positions, orientations, and ways, either in the same plane or in different planes, thereby forming an interlocked reinforcing structure which may extend not only along a course, but between courses. The same device may be used with different sized masonry elements, such as brick or block, and has sufficient flexibility so that it may also be employed with masonry elements having uneven or non-planer facing surfaces, such as stone, yet has sufficient strength to support without the aid of mortar or grout several courses of masonry elements. This is advantageous in enabling courses of masonry elements to be positioned on top of one another without mortar or other material being used in the joints, the masonry elements being entirely supported by the devices of the invention, and the joints later filled with a sealant or bonding material using a gun or other device which forces the material into the joints.

Broadly stated, a masonry construction device in accordance with the invention which affords the foregoing advantages may comprise first and second spaced members having a corregated profile in respective first and second planes, and a bridging member connected between the first and second members to maintain the members in spaced relationship with the first and second planes being substantially parallel.

More specifically, the masonry construction device may have an open rectangular substantially U-shaped configuration, the longitudinal sides or legs of which are elongated members formed to have a sawtooth shape so as to provide a plurality of spaced oppositely disposed bearing surfaces for spacing adjacent masonry elements a predetermined distance apart, and a transverse bridging member connected to the sawtooth shaped legs to maintain the legs in spaced relationship. The sawtooth shaped legs are formed such that the distances between successive bearing surfaces which engage the same masonry element are equal, and such that the bearing surfaces which engage one masonry element are located midway between the oppositely disposed bearing surfaces of the leg which engage the other masonry element. The members which form the device may have a substantially circular cross section, and preferably have a diameter which is substantially less than the predetermined distance between the spaced bearing surfaces provided by the leg so that the legs may interlock to one or more members of another such device.

BRIEF DESCRIPTION OF THE DRAWINGS

FIGS. 1A–C are a perspective view of a masonry construction device in accordance with a first embodiment of the invention, and enlarged cross sectional views taken along the lines 1B—1B and 1C—1C, respectively;

FIG. 2 is a perspective view illustrating the manner in which devices in accordance with the invention may be employed in interlocking relationship for spacing and reinforcing masonry elements, the view illustrating in particular the manner in which right angled courses may be connected together;

FIG. 6 is a perspective view somewhat similar to FIG. 2 illustrating the manner in which devices in accordance with the invention may be employed for connecting courses which lie at an angle other than a right angle; and FIG. 7 is an exploded perspective view illustrating another embodiment of a masonry construction device in accordance with the invention.

DESCRIPTION OF PREFERRED EMBODIMENTS

Figure 3:
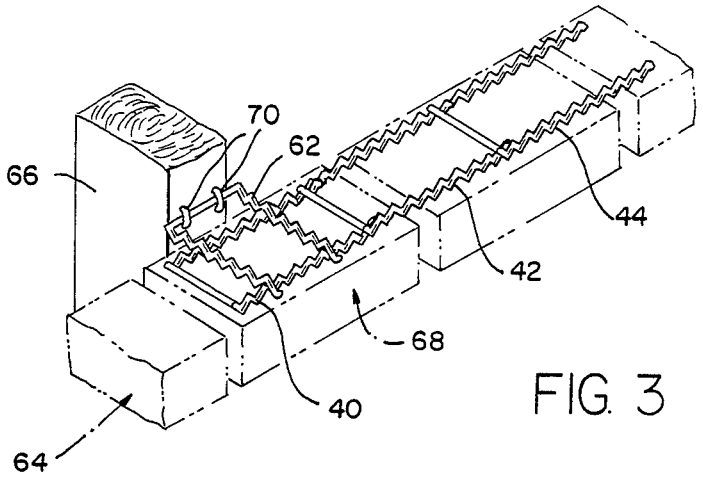
FIG. 3 is a perspective view illustrating the use of a device in accordance with the invention for tying a masonry construction to an adjacent structure.

FIGS. 1A–C illustrate a masonry construction device 10 in accordance with a first embodiment of the invention. As shown, device 10 may comprise first and second spaced longitudinally extending members 12 and 14 which may be connected together by a bridging member 16. Bridging member 16 maintains members 12 and 14 in spaced generally parallel relationship to one another. The bridging member may extend transversely to members 12 and 14 and may be connected to the members at ends 18 thereof so as to impart to device 10 an open rectangular substantially U-shaped configuration, as shown. Members 12 and 14 may have a corrugated or undulating profile in respective spaced, substantially parallel, vertically extending (in the figures) planes A and B. The planes are preferably normal to bridging member 16, as shown in FIG. 1B, and each of the members 12 and 14 is preferably sawtooth shaped in its respective plane, as shown in FIG. 1C. Members 12 and 14 thus provide in their respective planes a plurality of successive oppositely disposed upper and lower (in the figures) peaks or ridges 20 and 22, respectively.

For reasons to be explained more fully hereinafter, the horizontal distances between successive or adjacent upper peaks 20 and between successive or adjacent lower peaks 22 are preferably equal, and the lower peaks are preferably disposed longitudinally midway between the upper peaks, as illustrated in FIG. 1C. This may be accomplished by forming each member such that the inclined portions 24 of the member which meet to form the upper and lower peaks are at an angle of 45° relative to a vertical line through the peak. The lengths of portions 24 are selected to provide a predetermined vertical spacing between the oppositely disposed.upper and lower peaks. Members 12 and 14 are located relative to one another such that they have parallel profiles, and bridging member 16 is preferably connected to members 12 and 14 at a corresponding peak. In the figures, the bridging member is shown connected between corresponding upper peaks. However, as will be appreciated, this is relative to the orientation of device 10, since the device may be flipped over 180° and still have the same configuration except that the bridging member would extend between what would then be lower peaks.

Device 10 is adapted to be disposed between adjacent masonry elements with peaks 20 and 22 engaging the facing surfaces of the adjacent masonry elements. The peaks thus constitute a plurality of bearing surfaces or points for the adjacent masonry elements and serve to space the adjacent masonry elements apart by the predetermined spacing between oppositely disposed peaks 20 and 22. The spaced members 12 and 14 provide bearing points transversely spaced across the facing surfaces of the elements to insure that a uniform spacing is maintained between the adjacent masonry elements across the joint. Bridging member 16 maintains the transverse spacing between members 12 and 14 and prevents the members from rotating about a longitudinal axis of the device so that they remain in substantially parallel planes.

Figure 4:
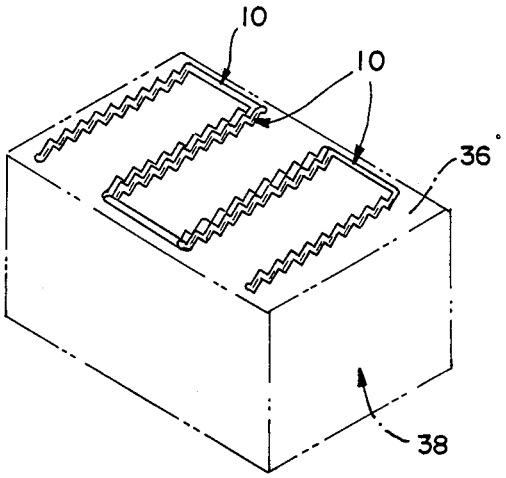
FIG. 4 is a perspective view illustrating the use of multiple devices in accordance with the invention with oversize masonry elements.

As shown in FIGS. 2, 3 and 6, device 10 is preferably sized so that its length and width are less than the length and width of the masonry element with which it is used. For standard size brick, for example, device 10 may have a length (the length of members 12 and 14) of the order of $4\frac{3}{4}$ inches and a width of the order of $2\frac{1}{4}$ inches. As shown in FIG. 2, for example, this locates members 12 and 14 on a facing surface 30 inwardly from the opposite sides 32 of the brick, but spaces members 12 and 14 sufficiently apart in a transverse direction to provide good support for the adjacent bricks and enables the device to be contained entirely within the joint and hidden from view when the joint is filled with mortar. By maintaining the length of members 12 and 14 less than the length of the brick, the tendency for the ends of the members which are opposite from the bridging member 16 to twist under the weight of an adjacent brick is minimized, and this affords a convenient size for the device. To enable the device to be employed between the ends 34 of the brick and for spacing different types of masonry elements, the length of members 12 and 14 may be readily adjusted, as by cutting them to size. FIG. 4 illustrates, for example, the use of three devices disposed transversely on the face 36 of an oversized masonry element, such as a block 38. The thickness of typical joints in masonry construction is between $\frac{1}{4}$ inch and $\frac{1}{2}$ inch, and the sawtooth shaped members 12 and 14 are formed such that the distances between peaks 20 and 22 corresponds to the desired joint thickness, $\frac{3}{8}$ inch, for example. This results in the longitudinal spacing between successive peaks 20 or 22 being approximately $\frac{1}{2}$ inch.

As shown in FIGS. 1B and 1C, members 12, 14 and 16 of device 10 may comprise elongated members having a substantially circular cross section which are shaped and interconnected to afford the configuration illustrated in the figures. The diameter of the members is preferably substantially smaller than the distance between opposite peaks 20 and 22 to enable the members of two or more devices to cross each other and interlock in the manner illustrated in FIGS. 2, 3 and 6, as will be explained more fully shortly. The device may be formed of any durable material, such as injection molded plastic, and is preferably formed from a continuous length of wire, as of steel, which is shaped into the configuration illustrated. If steel wire is employed, it may be galvanized, copper coated, or otherwise hot or cold dipped to afford corrosion resistance. Steel wire having a gauge of the order of 18 to 22, for example, is suitable.

Devices formed as described and shown in the drawings have a number of advantages. First, this permits devices to be interlocked in a variety of different ways and in a variety of different relative positions, angles and orientations, in the same or in different planes, so as to afford a substantially continuously interlocked reinforcing system. As shown in FIGS. 2, 3 and 6, devices 40, 42, 44 may be interlocked together lengthwise in the safe plane so as to extend along a course and so that they span adjacent masonry elements. This is accomplished by connecting the devices end-to-end lengthwise with the bridging members of one device located in the recesses between adjacent peaks of the device to which it is connected. This affords a continuously interlocked reinforcing structure along the course. At the same time, the oppositely disposed peak of the devices serve to space the next higher course a predetermined distance above the first course so that a uniform joint thickness is obtained.

The devices may also be employed between the ends of adjacent elements in the same course to space the elements uniformly, as shown at 46 and 48, for example, in FIG. 2. As shown, devices 46 and 48 are disposed in orthogonal planes to devices 40, 42, and 44. Devices 46 and 48 are simply placed over devices 40 and 42, respectively, so that their bridging members lie in the recesses between adjacent peaks and they hang down in the joints between adjacent elements. The lengths of the sawtooth shaped members of devices 46 and 48 may be readily adjusted in accordance with the height of the masonry elements by cutting the members to size, as by using wire cutters, for example.

FIG. 2 further illustrates the use of a device 50 for tying together two courses at right angles. As shown, device 50 is simply placed on masonry element 52 so as to span across the joint between element 52 of one course and element 54 of the other course, and such that the ends of device 50 are interlocked to one of the members of device 44. FIG. 6 illustrates a somewhat similar arrangement where a device 56 is employed for tying together two courses which are oriented at other than a right angle to one another. Device 56 is placed on an angle cut element 58 of one course so as to span the joint between element 58 and an adjacent element 60 of the other course and so that device 56 interlocks with devices 42 and 44 on the other course. FIGS. 2 and 6 are good illustrations of the manner in which the devices interlock at different angular positions within the same plane.

FIG. 3 shows the manner in which a device 62 in accordance with the invention may be employed for tying a masonry construction 64 to an adjacent structure 66. Construction 64 may be a brick veneer wall, for example, and structure 66 may comprise a wooden beam or a support, as of an inner wall (not shown). As shown, device 62 is positioned to extend beyond the side of a masonry element 68 with the device interlocked with device 40 which extends along the course on the masonry element. Device 62 may be tied to structure 66 as by using U-shaped fasteners 70 or the like.

In addition to affording very versatile interlocking, devices in accordance with the invention have other advantages. First, the sawtooth shaped members provide a plurality of spaced bearing points for supporting adjacent masonry elements and afford sufficient strength to the device so that it is capable of supporting several courses of masonry elements without mortar between the joints. This is convenient for erecting a portion of a free standing wall, for example, without using mortar, and subsequently filling in the joints with a bonding or sealing material fed into the joints under pressure using a conventional sealing gun or the like. The spaces between adjacent peaks enable the bonding material to flow between the members so that it completely fills the joint. Alternatively, devices in accordance with the invention may be placed into the wet mortar as the next course is laid, or placed on top of a masonry element and then covered with mortar. It is advantageous that the bearing surfaces, i.e., peaks 20 and 22, of the device are small in the planes of the surfaces of adjacent elements, since this minimizes mortar build-up on the peaks which could result in a non-uniform spacing.

Figure 5:
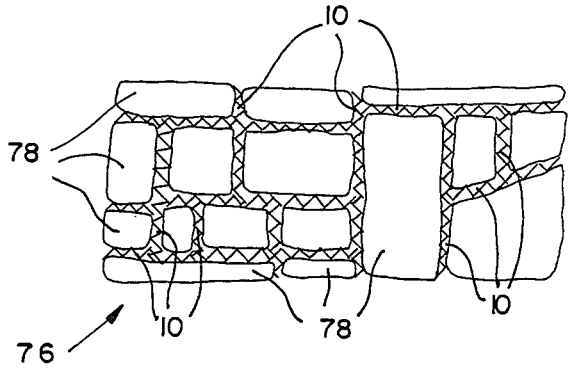
FIG. 5 is an elevation view illustrating the use of devices in accordance with the invention with masonry units having uneven or non-planer surfaces, such as stone.

The construction of the device 10 further affords sufficient flexibility to the device so that it can be used conveniently for spacing elements which have non-planar or uneven surfaces, such as stone. FIG. 5 illustrates devices 10 in accordance with the invention employed with a stone construction 76 formed of different size stones 78 having non-planar or non-uniform facing surfaces. The ease with which the devices can be readily sized for different lengths makes them particularly useful for such constructions, and the figure illustrates the interlocking versatility of the devices.

FIG. 7 illustrates another embodiment of the device 80 in accordance with the invention. Device 80 is similar to device 10 in employing sawtooth shaped members 12 and 14. However, the bridging member which connects members 12 and 14 comprises telescoping members 82 and 84 which enable the width of the device to be readily adjusted as desired to accommodate different width masonry elements.

From the foregoing, it may be appreciated that devices in accordance with the invention are very versatile and afford a number of significant advantages over other known masonry construction devices. Not only are they useful for uniformily spacing adjacent elements, but also their versatile interlocking capabilities are a significant advantage in affording an interlocked reinforcing structure between elements, thereby providing greater strength for the masonry construction. Moreover, as explained, the same device may be employed with different types and different sizes of masonry elements, thereby avoiding the necessity and inconvenience of requiring different devices for different applications.

While preferred embodiments of the invention have been shown and described, it will be apparent to those skilled in the art that changes may be made in these embodiments without departing from the principles and spirit of the invention, the scope of which is defined in the appended claims.

What is claimed is:

1. Interlocking spacer apparatus adapted to be disposed between adjacent masonry elements for spacing the adjacent masonry elements a predetermined distance apart comprising a U-shaped spacer device formed by first and second members extending parallel to one another in a longitudinal direction and being located in respective first and second spaced parallel planes, and a third straight transverse member extending substantially perpendicular to the first and second planes and connected to the first and second members for spacing the first and second members, each of the first, second and third members having a circular cross section and a substantially uniform diameter, the first and second members each being sawtooth-shaped over substantially its entire length in its respective plane to provide, on one side of the member, a plurality of first ridges and valleys alternating along the length of the member and, on an opposite side of the member, a plurality of second alternating ridges and valleys, the first and second ridges being connected together by straight portions of the member so as to impart said sawtooth shape to the member and being spaced apart in the respective plane of the member by said predetermined distance and providing corresponding pluralities of bearing points for engaging and spacing the masonry elements, and the diameter of said members being less than a longitudinal distance in said places between adjacent ones of said alternating ridges such that a member of another U-shaped device may cross one of the first and second members at an angle and be received within a valley between the adjacent ridges to interlock the U-shaped devices together with the first and second ridges of the U-shaped devices being at substantially the same levels.

2. Apparatus according to claim 1, wherein the first and second members are formed to have substantially identical sawtooth-shaped parallel profiles in the respective planes.

3. Apparatus according to claim 1, wherein each of the first and second members is formed such that said first ridges are spaced longitudinally apart along the member by the same distance that the second ridges are spaced longitudinally apart along the member and such that the second ridges are located longitudinally substantially midway between the first ridges.

4. Apparatus according to claim 3, wherein the valleys are located midway between the adjacent ridges with which they alternate.

5. Apparatus according to claim 3, wherein the longitudinal spacing between adjacent ridges is sufficiently greater than the diameter of the members such that said other U-shaped device can cross the first-mentioned U-shaped device at a plurality of different orientations.

6. Apparatus according to claim 1, wherein the spacer device has a length in the longitudinal direction and a width transverse to the longitudinal direction which are less than a length and width of a standard masonry element.

7. Apparatus according to claim 1, wherein the first and second members of said first device cross said one member of said second device at other than a right angle.

8. Interlocking spacer apparatus adapted to be disposed between adjacent masonry elements for spacing the adjacent masonry elements a predetermined distance apart comprising a spacer device formed of first and second spaced, longitudinally extending, substantially parallel members disposed in respective first and second parallel planes, each member having a continuous sawtooth shape over substantially its entire length to provide in its respective plane a first plurality of ridges regularly spaced by the same spacing in the longitudinal direction and located on one side of the member and a second plurality of ridges regularly spaced by said spacing in the longitudinal direction on an opposite side of the member, the ridges of the second plurality being located longitudinally between the ridges of the first plurality and being connected thereto by straight portions of the member so as to impart said sawtooth shape to the member, the first plurality of ridges being separated in the respective plane from the second plurality of ridges by said predetermined distance and providing respective first and second pluralities of bearing surfaces for engaging and spacing the adjacent masonry elements, and a straight bridging member extending in a transverse direction perpendicular to said first and second planes and being connected to said first and second members for spacing the first and second members, each of said members having a circular cross section and a diameter which is substantially less than both said regular longitudinal spacing between the ridges and the predetermined distance between said first and second pluralities of ridges so as to enable a member of another such spacer device to be received within spaces between adjacent ridges of the first and second members of the first-mentioned spacer device so as to interlock said spacer devices together.

9. Apparatus according to claim 8, wherein the bridging member is connected to the first and second members at first ends of the first and second members, and second opposite ends of the first and second members are open to impart to the spacer device an open rectangular U-shape.

10. Apparatus according to claim 9, wherein the bridging member is formed of material having sufficient resiliency to enable relative movement between the first and second members.

11. Interlocking spacer apparatus adapted to be disposed between adjacent masonry elements for spacing the masonry elements a predetermined distance apart comprising an open rectangular U-shaped frame formed of resilient wire, the frame having first and second spaced longitudinally extending substantially parallel side members formed to have a continuous sawtooth shape over substantially their entire length in respective first and second spaced parallel planes, and a transversely extending straight bridging member connected to one end of the side members, the bridging member being normal to said first and second parallel planes, each side member being formed by a plurality of straight portions which are located in the plane of the member and which are interconnected at opposite ends thereof, said portions being alternately inclined in opposite directions relative to a straight line in said longitudinal direction to form said sawtooth shape, and each side member providing in its respective plane, at said interconnected ends of said straight portions, a first plurality of bearing points on a first side of said line and a second plurality of bearing points on an opposite side of said line for engaging and spacing the adjacent masonry elements, the first plurality of bearing points being spaced from the second plurality of bearing points in said respective plane by said predetermined distance, and said bearing points of each of said first and second pluralities being spaced equally in the longitudinal direction over the length of the side member with the bearing points of said first plurality being located longitudinally between the bearing points of said second plurality, and wherein said members each have a diameter which is substantially less than both the longitudinally spacing between bearing points and said predetermined distance so as to enable a member of another spacer device to be received between adjacent bearing points to interlock the spacer devices together.

12. Apparatus according to claim 11, wherein said spacer device is formed of steel wire.

13. Apparatus according to claim 11, wherein the first and second side members have parallel profiles in their respective planes such that corresponding bearing points of said first and second side members are located longitudinally at the same distance from said one end of the first and second members.

14. Interlocking spacer apparatus adapted to be disposed between adjacent masonry elements for spacing the adjacent masonry elements a predetermined distance apart comprising first and second U-shaped spacer devices, each device being formed by first and second members extending parallel to one another in a longitudinal direction and being located in respective first and second spaced parallel planes, and a third straight transverse member extending substantially perpendicular to the first and second planes and connected to the first and second members for spacing the first and second members, each of the first, second and third members having a circular cross section and a substantially uniform diameter, the first and second members each being sawtooth-shaped over substantially its entire length in its respective plane to provide, on one side of the member, a plurality of first ridges and valleys alternating along the length of the member and, on an opposite side of the member, a plurality of second alternating ridges and valleys, the first and second ridges being connected together by straight portions of the member so as to impart said sawtooth shape to the member and being spaced apart in the respective plane of the member by said predetermined distance and providing corresponding pluralities of bearing points for engaging and spacing the masonry elements, and the diameter of said members being less than a longitudinal distance in said planes between adjacent ones of said alternating ridges such that a member of another U-shaped device may cross one of the first and second members at an angle and be received within a valley between the adjacent ridges to interlock the U-shaped devices together with the first and second ridges of the U-shaped devices being at substantially the same levels, and wherein the first and second devices lie in a common plane which is orthogonal to said parallel planes and are positioned such that the first and second members of the first device cross one of the first and second members of the second device with a ridge of each of the first and second members of the first device located between adjacent ridges of said one member of the second device.

15. Interlocking spacer apparatus adapted to be disposed between adjacent masonry elements for spacing the adjacent masonry elements a predetermined distance apart comprising first and second U-shaped spacer devices, each device being formed by first and second members extending parallel to one another in a longitudinal direction and being located in respective first and second spaced parallel planes, and a third straight transverse member extending substantially perpendicular to the first and second planes and connected to the first and second members for spacing the first and second members, each of the first, second and third members having a circular cross section and a substantially uniform diameter, the first and second members each being sawtooth-shaped over substantially its entire length in its respective plane to provide, on one side of the member, a plurality of first ridges and valleys alternating along the length of the member and, on an opposite side of the member, a plurality of second alternating ridges and valleys, the first and second ridges being connected together by straight portions of the member so as to impart said sawtooth shape to the member and being spaced apart in the respective plane of the member by said predetermined distance and providing corresponding pluralities of bearing points for engaging and spacing the masonry elements, and the diameter of said members being less than a longitudinal distance in said planes between adjacent ones of said alternating ridges such that a member of another U-shaped device may cross one of the first and second members at an angle and be received within a valley between the adjacent ridges to interlock the U-shaped devices together with the first and second ridges of the U-shaped devices being at substantially the same levels, and wherein the first and second devices are located in respective third and fourth planes which are non-parallel with respect to one another such that the third member of the first device crosses the first and second members of the second device and is located between adjacent ridges of the first and second members of the second device.

* * * * *

UNITED STATES PATENT AND TRADEMARK OFFICE

CERTIFICATE OF CORRECTION

PATENT NO. : 4,756,136

DATED : July 12, 1988

INVENTOR(S) : HODGES

It is certified that error appears in the above-identified patent and that said Letters Patent is hereby corrected as shown below:

Column 7, line 59, change "claim 1" to -- claim 14 --.

Signed and Sealed this

Twenty-second Day of November, 1988

*Attest:*

DONALD J. QUIGG

*Attesting Officer*

*Commissioner of Patents and Trademarks*